US008091401B2

(12) United States Patent
Chen

(10) Patent No.: US 8,091,401 B2
(45) Date of Patent: Jan. 10, 2012

(54) NEW-TYPE THIN SHREDDER BLADE HAVING BLADE POINTS WITHOUT STEPS, BLADE SETS AND MANUFACTURING METHOD THEREOF

(75) Inventor: Hsin-Hsiung Chen, Shanghai (CN)

(73) Assignee: Aurora Office Equipment Co., Ltd, Shanghai (CN)

( * ) Notice: Subject to any disclaimer, the term of this patent is extended or adjusted under 35 U.S.C. 154(b) by 0 days.

(21) Appl. No.: 12/890,577

(22) Filed: Sep. 24, 2010

(65) Prior Publication Data

US 2011/0072876 A1 Mar. 31, 2011

Related U.S. Application Data

(62) Division of application No. 12/423,365, filed on Apr. 14, 2009.

(30) Foreign Application Priority Data

Dec. 25, 2008 (CN) ..... 2008 1 0207701

(51) Int. Cl.
*B02C 18/16* (2006.01)
*B21K 5/12* (2006.01)

(52) U.S. Cl. ..... 72/330; 72/337; 72/363; 72/379.2; 241/297; 76/115

(58) Field of Classification Search ..... 72/329, 72/330, 337, 363, 377, 379.2; 241/295, 297; 76/115

See application file for complete search history.

(56) References Cited

U.S. PATENT DOCUMENTS

| | | | | |
|---|---|---|---|---|
| 2,547,941 | A * | 4/1951 | Heftler | 72/363 |
| 4,176,444 | A * | 12/1979 | Walker | 72/402 |
| 6,390,400 | B1 | 5/2002 | Huang | |
| 7,044,410 | B2 * | 5/2006 | Hunag | 241/295 |
| 7,048,218 | B2 * | 5/2006 | Hunag | 241/295 |
| 7,328,867 | B1 | 2/2008 | Lo | |
| 7,401,737 | B2 | 7/2008 | Huang et al. | |
| 7,533,839 | B2 | 5/2009 | Wang | |
| 7,637,448 | B2 | 12/2009 | Hartnett et al. | |
| 7,644,881 | B2 | 1/2010 | Huang | |
| 2005/0109866 | A1 | 5/2005 | Hunag | |
| 2008/0040934 | A1 | 2/2008 | Zeng | |
| 2009/0256020 | A1 | 10/2009 | Sued et al. | |

FOREIGN PATENT DOCUMENTS

CN 03229036.5 2/2003

(Continued)

*Primary Examiner* — David Jones
(74) *Attorney, Agent, or Firm* — Wang, Hartmann, Gibbs & Cauley; John F. O'Bourke; Erick P. Wolf

(57) ABSTRACT

Thin shredder blade having blade points without steps, including blade body and cutting part located on periphery of blade body and includes a blade point. The cutting part includes a primary protrusion protruding from the cutting part. The primary protrusion includes a top, an inclined plane extending between the top and blade point, and an acute angle formed by inclined plane and blade body. The plane is an inverted triangle. The cutting part further includes first and second hemlines extending from the blade body and intersecting to the blade point. A first plane extends between the top and first hemline and intersects with the inclined plane. The blade body includes a large protrusion which protrudes in the same direction as the primary protrusion. The blade sets formed by the thin blades and the manufacturing method of the thin blades are provided.

14 Claims, 12 Drawing Sheets

FOREIGN PATENT DOCUMENTS

| | | |
|---|---|---|
| CN | 200420095552.7 | 11/2004 |
| CN | 200520054649.8 | 2/2005 |
| CN | 200520106376.7 | 8/2005 |
| CN | 200520105354.9 | 9/2005 |
| CN | 200530143392.93 | 10/2005 |
| CN | 200530143393.3 | 10/2005 |
| CN | 200520066862.0 | 11/2005 |
| CN | 20053067480.2 | 12/2005 |
| CN | 200530167481.7 | 12/2005 |
| CN | 200530167482.1 | 12/2005 |
| CN | 200620055119.X | 2/2006 |
| CN | 200620056512.0 | 3/2006 |
| CN | 200620057862.9 | 4/2006 |
| CN | 20620014030.9 | 5/2006 |
| CN | 200620024483.X | 5/2006 |
| CN | 200620014187.1 | 6/2006 |
| CN | 200620014360.8 | 6/2006 |
| CN | 200620063942.5 | 9/2006 |
| CN | 200720118735.X | 2/2007 |
| JP | 20044130162 | 4/2004 |
| WO | PCT/EP2008/063952 | 10/2008 |

* cited by examiner

NEW-TYPE THIN SHREDDER BLADE HAVING BLADE POINTS WITHOUT STEPS, BLADE SETS AND MANUFACTURING METHOD THEREOF

CROSS REFERENCE TO RELATED APPLICATIONS

This Application is a Divisional Application of related, co-pending U.S. patent application Ser. No. 12/423,365, filed on Apr. 14, 2009, and claims benefit of priority to CN Application No. 200810207701.7, filed Dec. 25, 2008, the content of which is incorporated by reference herein.

TECHNOLOGY FIELD

The present invention relates to a thin shredder blade, specifically to a thin shredder blade, and more specifically to a thin shredder blade having blade points without steps formed by mechanical punching or die casting, related blade sets formed correspondingly and manufacturing method.

BACKGROUND TECHNOLOGY

At present, the basic working principle of the cross-cut shredders commonly used is that blades combined with spacing rings are mounted on a shaft, and two parallel shafts driven by a motor cooperated with a gear mechanism rotate reversely to form a shearing force to cut papers passing through into thin strips. Please refer to the common shredder blade shown in FIG. 1 and the common shredder blade assembly shown in FIG. 2, and the common shredder blade is made of a metal sheet and molded by mechanical punching through a die to be a circular shredder blade the center of which has a polygonal central hole 1 into which the shaft can insert, and the circumference of which protrudes outwardly to form uniform cutting edges 2, when a blade set H is formed by combining two shredder blades mounted on the shaft F in a back-to-back manner as shown in FIG. 2, the uniform cutting edges of these two shredder blades would assume a V-like knife-edge 3, while on an opposite shaft F', another blade set H' is formed by combining two shredder blades spaced by a spacing ring in a face-to-face manner. When papers to be shredded pass through the two reverse rotatory shafts F and F', the opposing rotation of the blade circumferences, i.e. the blade bodies 4 and 4', would cut the papers like scissors into strips, and the opposing rotation of the knife-edge 3 and the opposite blade body 4' then would cut the strips crossly to fragment the strips into chips.

Now the shredder blade used commonly in the common shredders is usually formed integrally by punching a metal sheet having a thickness of more than 1 mm with a die, then a single blade set is 1×2 mm in thickness, which results in the width of the shredded paper obtained is 1×2 mm correspondingly. Because in the shredding process, firstly the blade points of two opposite blade sets penetrate the paper to make holes, then the paper is cut and fragmented into chips (as shown in FIG. 2), due to the width of the cut paper equals to the thickness of the common blade set, and in order to ensure the strength of the shredder blades in the horizontal cutting, the strength of the blade points should be relatively high, the thickness of the shredder blade can not be too thin, otherwise the cutting edge would be deformed and even broken, so the shredder blade is made by punching the relatively thick materials, which makes the high material cost that is unable to adapt to the shredder industry status of the increasingly severe shredder price competition. In addition, for the thickness of the commonly used shredder blades can not be reduced, and the shredder blade is a solid body, its quality is relatively big and needs a relatively high power to drive the two shafts having blade sets to shred papers.

A thin shredder blade is made by punching at the cutting part of a thin metal sheet to form a protrusion 6, which reduces the material cost greatly, while the cutting part (including the blade point 5) has a relatively high strength, but due to the processing method, there is a step between the blade point 5 and the protrusion 6 (as shown in FIG. 3), when two shredder blades AI and BI having blade points with a step form a blade set in a back-to-back manner (as shown in FIGS. 4*a* and 4*b*), the knife-edge penetrating the papers is not progressive, as shown by the curve line 7, the resistance force is increased abruptly, and papers are torn off and are not cut like traditional solid shredder blades, and for the two blade points 5 are relatively small, they would break even rupture to be unable to cut the papers in the continuous use, and also the too small blade points 5 would grasp the chips which would then accumulate in the continuous use to increase the resistance force to the motor and break down the blade points 5, thus, the blade point with a step limits the application of this kind of thin shredder blades severely.

In order to solve the existing problems and shortcomings mentioned above, it is necessary to improve the common thin shredder blades.

DISCLOSURE OF THE INVENTION

Aspects of the present invention generally pertains to a thin shredder blade having blade points without steps, related blade sets and manufacturing method, with the blade sets formed by the thin shredder blade having blade points without steps. In one aspect, the shredder can reduce the production cost and the energy consumption greatly, while meet the same cutting requirement of the common shredder entirely.

In a first aspect of the present invention, a thin shredder blade having blade points without steps is provided, and comprises at least one blade body and at least one cutting part, the cutting part is located on the periphery of the blade body and includes a blade point, In an aspect, the cutting part at least further comprises a protrusion which protrudes from the cutting part and includes a top, a inclined plane extends between the top and the blade point, and an acute angle is formed by the inclined plane and the blade body.

In a further aspect, the inclined plane is an inverted triangle.

In yet another aspect, the cutting part further includes a first hemline and a second hemline extending respectively from the blade body and intersecting to the blade point, a first plane extends between the top and the first hemline and intersects with the inclined plane.

In a further aspect, the cutting part is formed integrally.

In a further aspect, two or more said cutting parts are arranged symmetrically.

In a further aspect, the blade body includes at least one large protrusion which protrudes in the same direction as the protrusion.

In yet another aspect, the large protrusion is an annular large protrusion.

In yet another aspect, the large protrusion is communicated with the protrusion.

In yet another aspect, the large protrusion is not higher than the protrusion.

In further aspect, the overall shape of the thin shredder blade can be circular, oval or regular polygonal. Of course, it may also be other suitable shapes.

In a further aspect, the thin shredder blade having blade points without steps has a polygonal hole at its center. The hole also can be other shapes, which depends on the shaft inserted.

In a second aspect of the present invention, a blade set formed by the thin shredder blades having blade points without steps is provided, and its characteristics are: it comprises two same above-mentioned thin shredder blades having blade points without steps.

In a further aspect, one said thin shredder blade having blade points without steps combines with the other said thin shredder blade having blade points without steps in a back-to-back manner.

In a further aspect, one said thin shredder blade having blade points without steps combines with the other said thin shredder blade having blade points without steps in a face-to-face manner.

In another aspect, it further comprises a spacing ring between the two thin shredder blades having blade points without steps.

In a third aspect of the present invention, a multi-step mechanical punching method is provided, and its characteristics are: it is used to manufacture the above mentioned thin shredder blades having blade points without steps, and comprises the following steps:

a. Punch a thin metal sheet having an archetypal blade, so that the archetypal cutting part of the archetypal blade protrudes from the middle to form an archetypal protrusion, thus the thickened archetypal cutting part is obtained;

b. Stack material thicker than the whole archetypal protrusion on the side surface of the archetypal cutting part;

c. Cut and punch the material stacked on the side surface to produce the inclined plane.

In one other aspect, in step b, a means of increasing the punching force is used to stack material thicker than the whole archetypal protrusion on the side surface of the archetypal cutting part.

In one aspect, in step b, a means of finishing is used to stack material thicker than the whole archetypal protrusion on the side surface of the archetypal cutting part.

In one aspect, in step b, a means of extruding or bending material is used to stack material thicker than the whole archetypal protrusion on the side surface of the archetypal cutting part.

In one aspect, in step a, it further comprises a step of punching the archetypal blade body of the archetypal blade, so that the archetypal blade body protrudes to form at least one large protrusion which protrudes in the same direction as the archetypal protrusion.

In yet another aspect, the large protrusion is an annular large protrusion.

In yet another aspect, the large protrusion is communicated with the archetypal protrusion. In yet another aspect, the large protrusion is not higher than the archetypal protrusion.

In one aspect, in step b, it further comprises a step of stack material thicker than the whole archetypal protrusion on the front surface of the archetypal cutting part;

In yet another aspect, in step c, it further comprises a step of cutting and punching the material stacked on the front surface to produce a first plane which extends between the top and the first hemline of the cutting part.

In yet another aspect, a means of increasing the punching force is used to stack material the thickness of which is thicker than the whole archetypal protrusion on the side surface of the archetypal cutting part.

In yet another aspect, a means of finishing is used to stack material thicker than the whole archetypal protrusion on the side surface of the archetypal cutting part.

In yet another aspect, a means of extruding or bending material is used to stack material thicker than the whole archetypal protrusion on the side surface of the archetypal cutting part.

The beneficial effects of the present invention are as follows:

1. The unique design of the cutting part of the present invention, including the protrusion, the inclined plane and the first plane, equals exactly to the cutting part of the solid shredder blade, for their shredding function and the strength of the blade points of them are same.

2. The unique design of the protrusion on the cutting part of the present invention thickens the cutting part, saves materials, and strengthens the strength of the entire blade point, which makes the cutting part to shred paper without broken.

3. The inclined plane of the present invention which extends between the protrusion and the blade point further strengthens the strength of the cutting part on the basis of the protrusion strengthening it, and at the same time makes two back-to-back shredder blades form a V-shaped cutting shape, which can fully achieve the same shredding request of common shredders.

4. The processing method of the cutting part of the present invention is artful and simple, for after the archetypal protrusion similar to a triangle is formed by punching a thin metal sheet, the material is stacked on the front surface and the side surface, then the inclined plane and the first plane of the cutting part are made by cutting and punching according to the shredding requirement.

5. The unique designs of the protrusion and the large protrusion of the present invention make the shredder blades achieve the same shredding requirement of common shredders, and at the same greatly reduce the weight of the blade, thereby greatly reduce the production cost and the energy consumption of the motor to save energy.

6. When the height of the protrusion of the present invention is smaller, the paper would be shredded smaller than that shredded by common shredders.

PREFERRED EMBODIMENTS OF THE INVENTION

Figure 1:
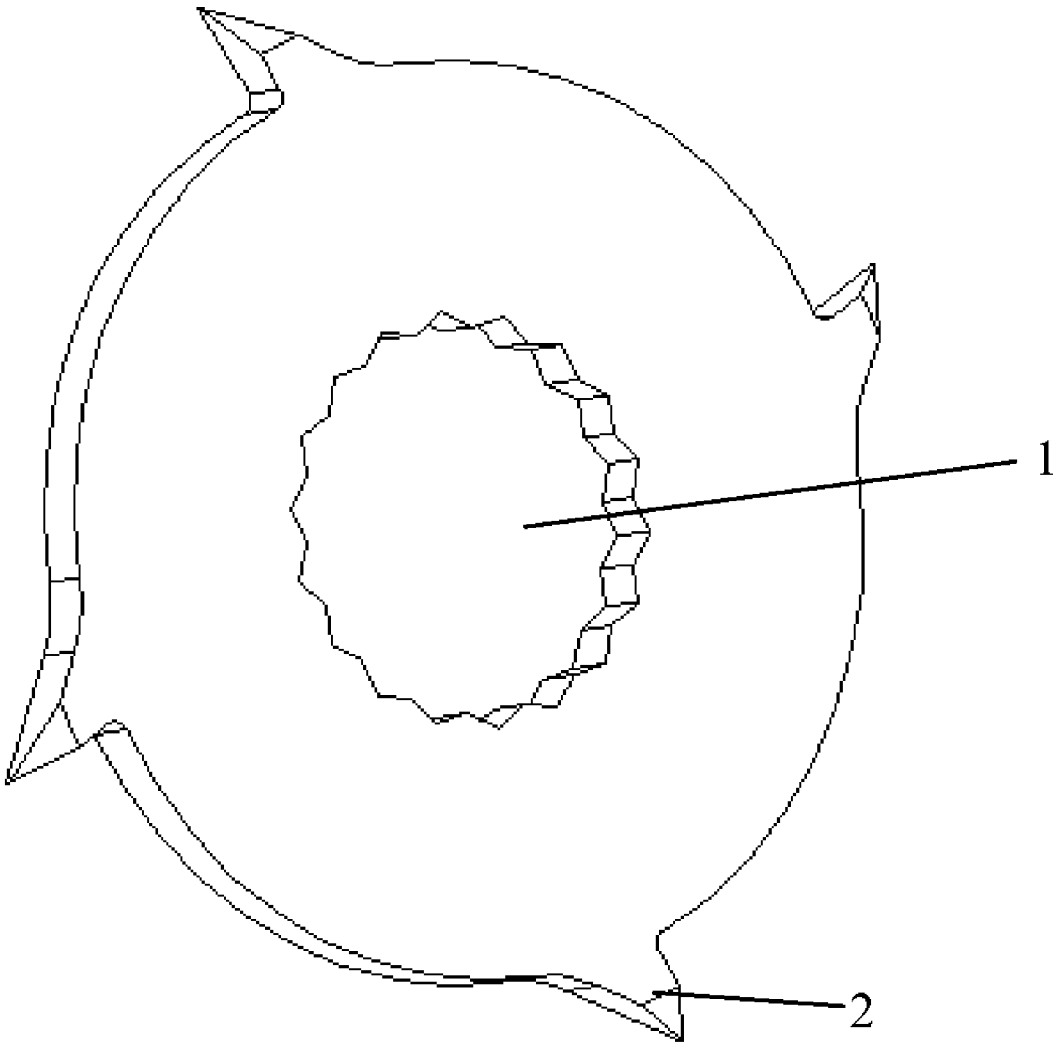
FIG. 1 is a schematic view of the prior art shredder blade.

In order to understand the technical content of the present invention more clearly, please refer to FIG. 5-FIG. 13. FIGS. 1, 2, 3, 4*a* and 4*b* are examples of the prior art.

In order to overcome the shortcomings of the prior art shredder blades, a thin shredder blade has been created after a long-term research and testing, which can substitute for the existing shredder blades completely, and achieve the same shredding requirement. Please refer to FIG. 5, the thin shredder blade 10 having blade points without steps, according to the teachings of the present invention, comprises mainly cutting parts 11 and a blade body 12, wherein:

The thin shredder blade 10 is a disk-shaped blade made from a metal sheet more than 0.3 mm by mechanical punching or die casting. The circumference of the disc-shaped blade protrudes outwardly to form a cutting part 11, or, if desired, cutting parts spaced a desired angle, that is, two or more cutting parts 11 are arranged symmetrically. Please refer to FIG. 5, FIG. 6, and FIG. 7, the cutting part 11 includes a blade point 111 and a primary protrusion 112 which protrudes from the cutting part 11 and includes a top 113, a inclined plane 114 extends between the top 113 and the blade point 111, and an acute angle is formed by the inclined plane 114 and the blade body 12. The inclined plane 114 is an inverted triangle. Of course, according to the shape of the primary protrusion 112, the inclined plane 114 can also be other shapes.

The cutting part 11 further includes a first hemline 115 and a second hemline 116 extending respectively from the blade body 12 and intersecting to the blade point 111; a first plane 117 extends between the top 113 and the first hemline 115 and intersects with the inclined plane 114.

Therefore, the inclined plane 114 and the first plane 117 combined with the primary protrusion 112 form the unique cutting part 11, the shape of which is similar to the general cutting edge of the common shredder blade and used to penetrate and cut the paper to be shredded.

Thus, the processing of the unique cutting part 11 is also different from that of the cutting part punched directly, and particularly adopts an innovative multi-step mechanical punching method to manufacture the unique cutting part 11 of the present invention, which has a shape similar to the common cutting edge, as well as the primary protrusion 112.

Figure 7:
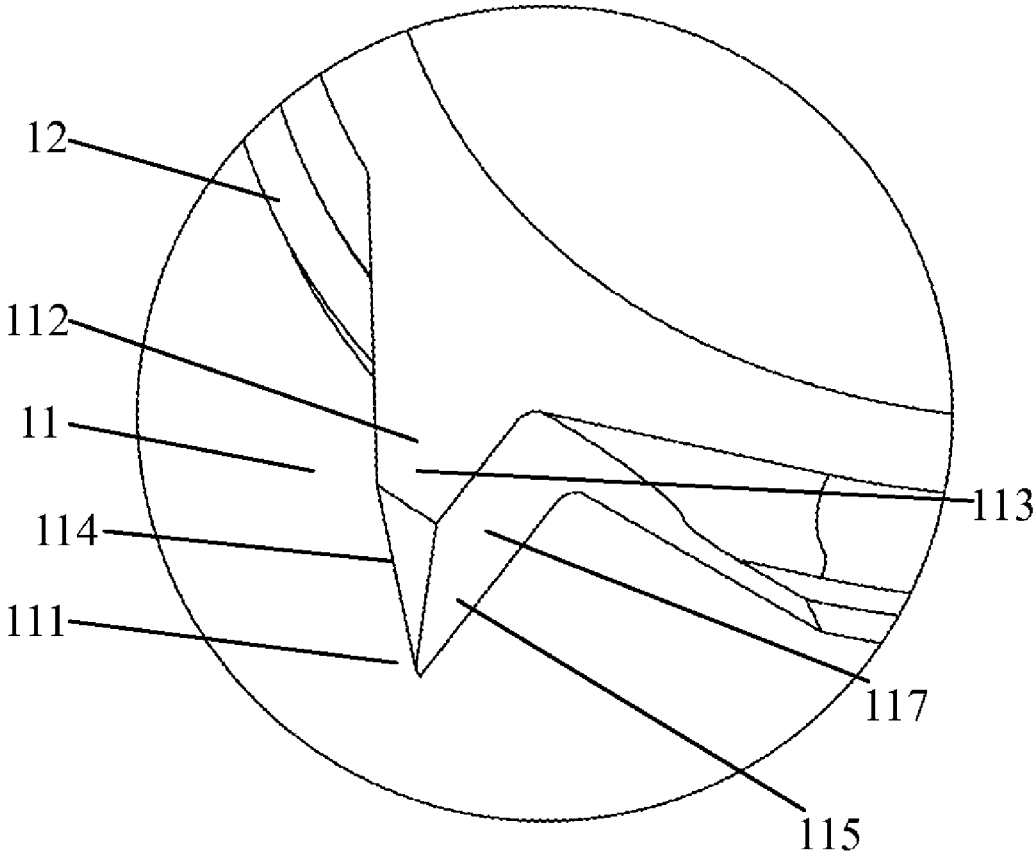
FIG. 7 is a partial enlarged schematic view of the area II of FIG. 6.
Figure 8A:
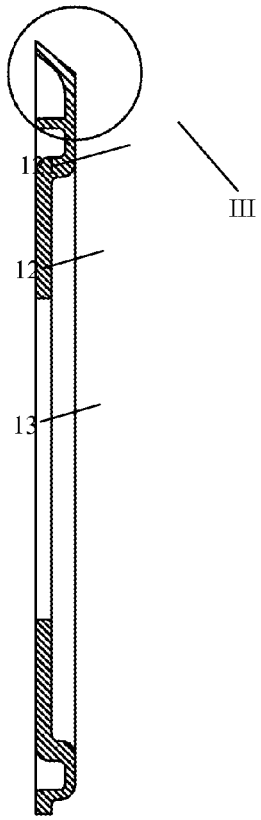
FIG. 8*a* is a vertical cutaway view of the example shown in FIG. 5.
Figure 8B:
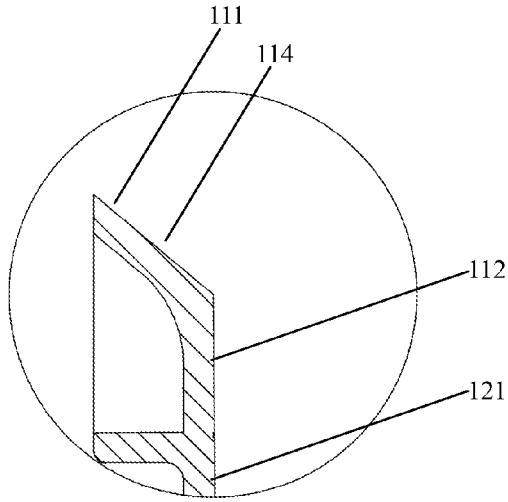
FIG. 8*b* is a partial enlarged schematic view of the area III of FIG. 8*a*.
Figure 8C:
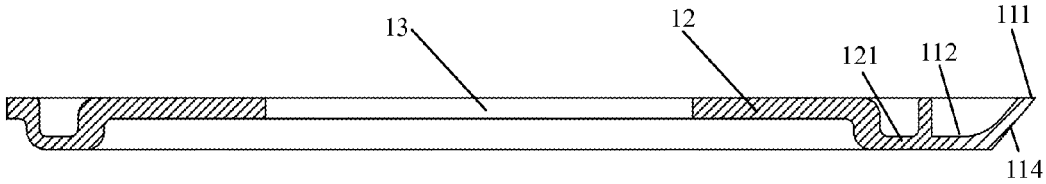
FIG. 8*c* is a transverse cutaway view of the example shown in FIG. 5.
Figure 9:
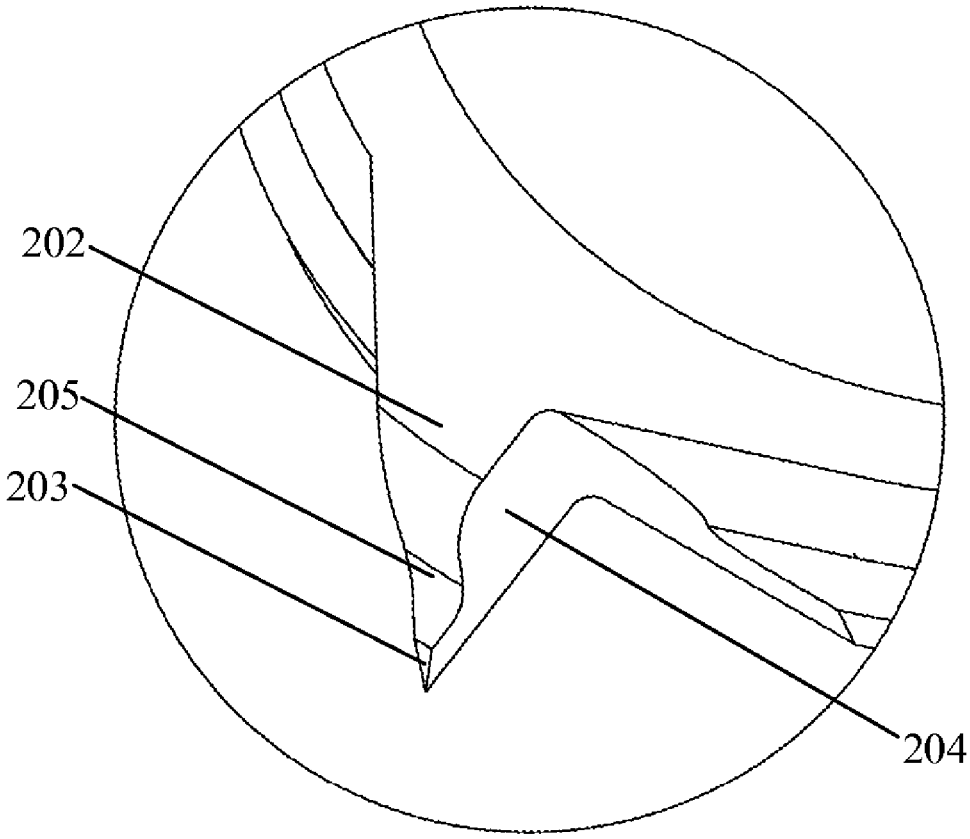
FIG. 9 is a partial enlarged schematic view of a semifinished product of the thin shredder blade in the process.
Figure 10:
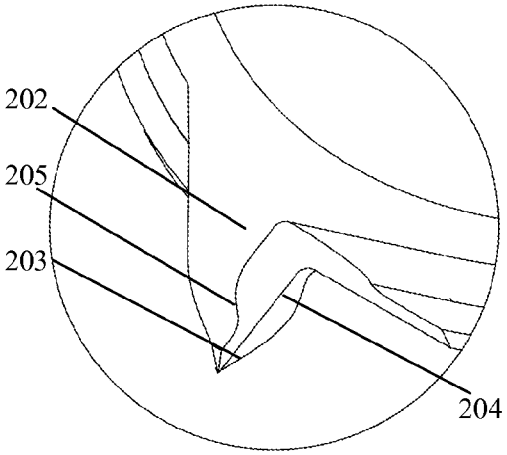
FIG. 10 is a schematic view of processing the key positions of the part shown in FIG. 9, in accordance with the teachings of the present invention.

The above-mentioned multi-step mechanical punching method comprises the following steps: first, punch a thin metal sheet having an archetypal blade, so that the archetypal cutting part of the archetypal blade protrudes from the middle to form an archetypal protrusion 202, thus the thickened archetypal cutting part is obtained, at this time, there is a step existed between the archetypal blade point 203 and the archetypal protrusion 202, as shown in FIG. 9; then stack material thicker than the whole archetypal protrusion 202 on the archetypal protrusion 202, the archetypal blade point 203, and the area between them, mainly on the front non-triangular surface 204 and the side non-triangular surface 205 of the archetypal cutting part, as shown in FIG. 10; then cut and punch the material stacked on the side surface 205 and the front surface 204 to form two planes, i.e. the inclined plane 114 and the first plane 117 as shown in FIG. 7, similar to those of the cutting part 2 of the common solid shredder blade.

Figure 11:
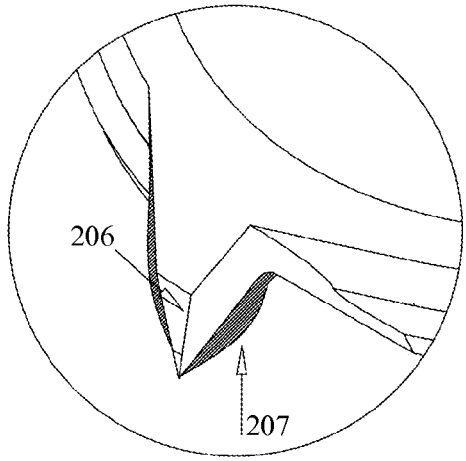
FIG. 11 is a schematic view of the direction of processing the key positions of the part shown 10 in FIG. 9, in accordance with the teachings of the present invention.

When the inclined plane 114 and the first plane 117 are being cut and punched, the two directions of cutting and punching can be the directions of the arrows 206 and 207 shown in FIG. 11. There also can be other appropriate directions.

The means of increasing the punching force or finishing can be used to stack material, for example, the means of finishing is used to stack material on the archetypal blade point 203, so as to produce an integrated cutting part 11. Of course, it can extrude or bend material from other surface(s) to achieve the aim of stacking material as shown in FIG. 10, but these means can not cause the cutting part 11 to achieve the strength achieved by the above-mentioned means.

Figure 5:
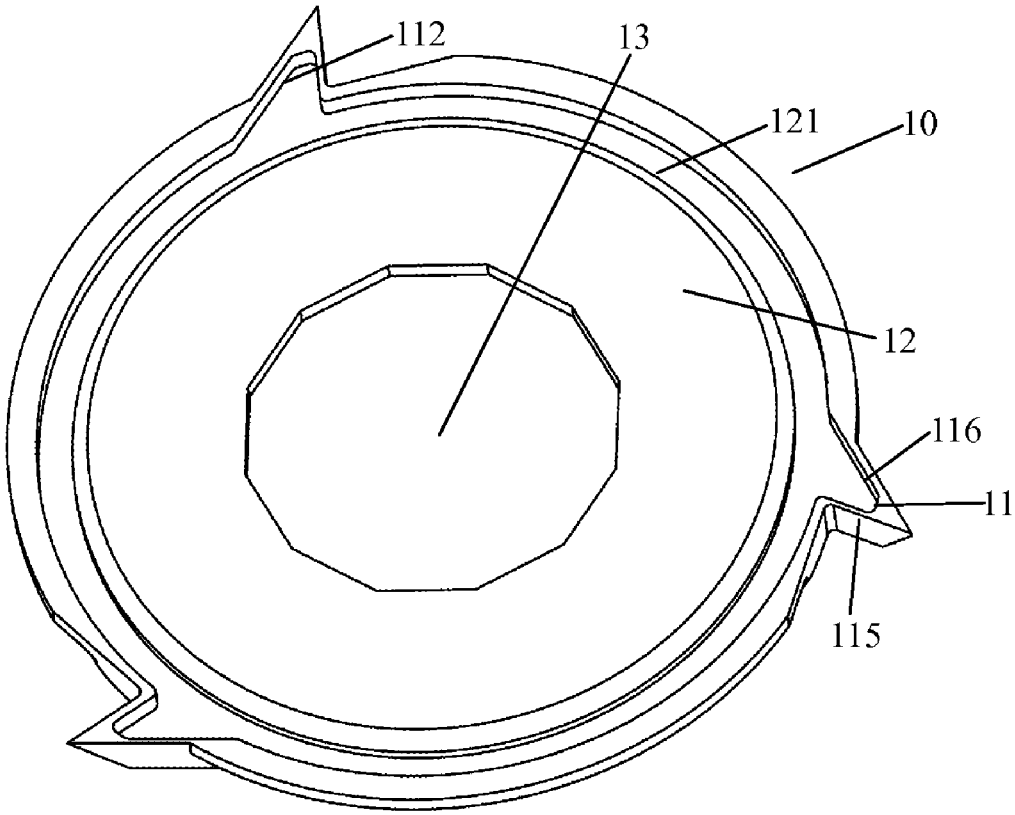
FIG. 5 is a perspective view of one example of the thin shredder blade having blade points without steps, in accordance with the teachings of the present invention.
Figure 6:
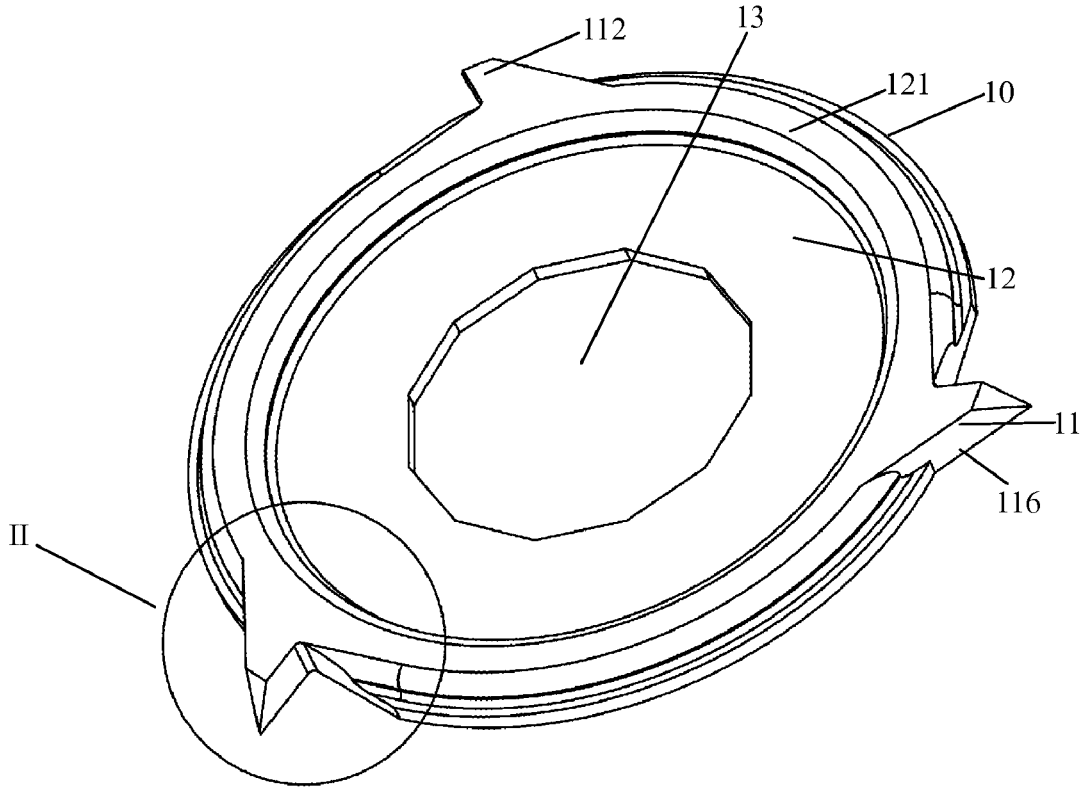
FIG. 6 is another perspective view of the example shown in FIG. 5.
Figure 13:
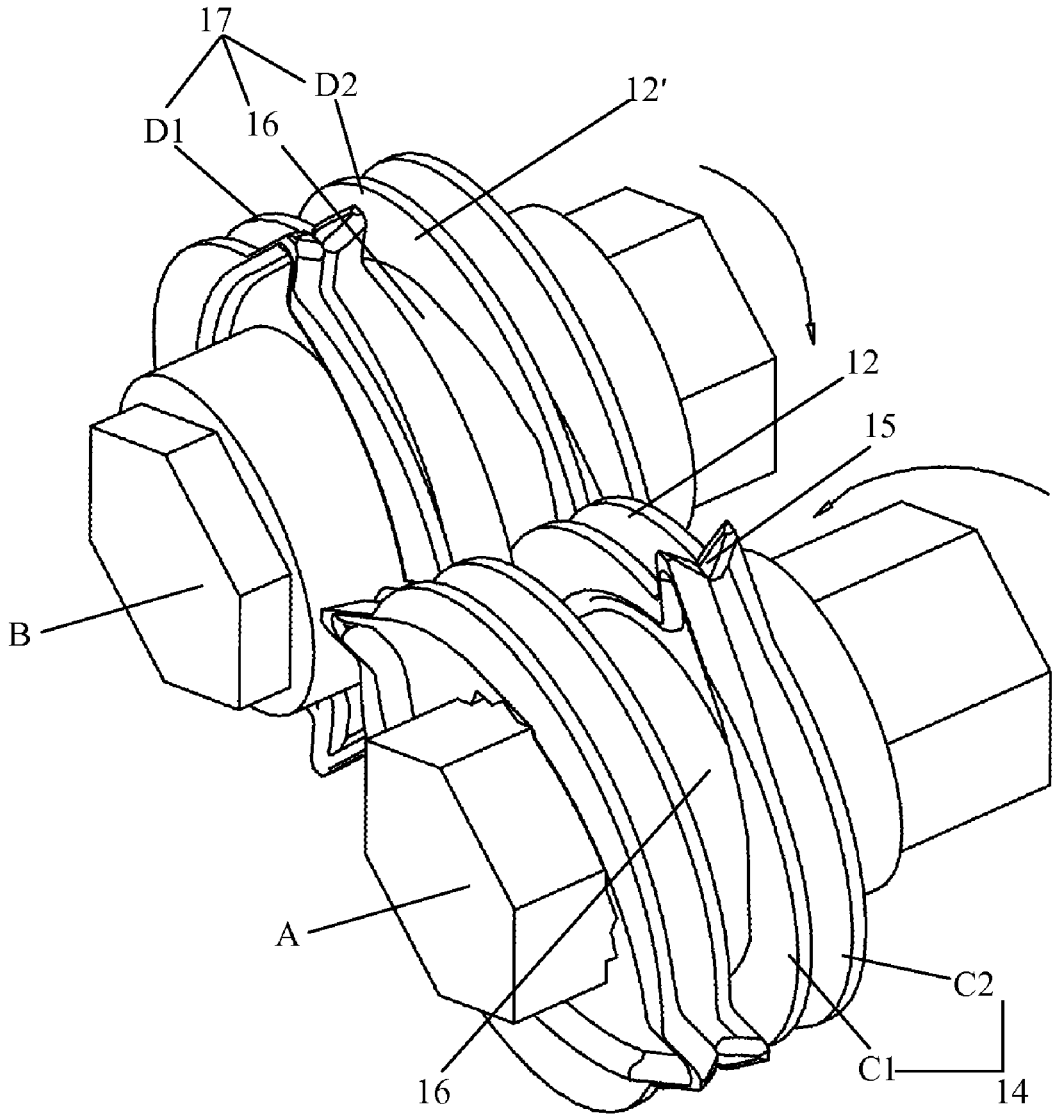
FIG. 13 is a schematic view of the blade assembly of the thin shredder blades having blade points without steps, in accordance with the teachings of the present invention.

The height of the primary protrusion 112 can be optional, i.e. the primary protrusion 112 causes the original thin blade more than 0.3 mm to achieve the required thickness of the entire form, as shown in FIG. 5, FIG. 6, and FIG. 7, so as to meet the requirement of chips with certain sizes, and strengthen the strength of the whole cutting part 11 which is further strengthened after stacking material, and cutting and punching, then the cutting part 11 can complete the shredding action without damage, and the blade set formed by combining two blades C1 and C2 is strong enough to fragment strips into chips (see FIG. 13).

The thin shredder blade 10 has at its center a central hole 13 through which the shredder shaft can pass. The central hole 13 is usually a polygonal hole into which a shaft can insert. It also can be other shapes, to accommodate the shaft inserted. An annular large protrusion 121 protrudes from the blade body 12 of the thin shredder blade 10 in the same direction as the primary protrusion 112, and is not higher than the primary protrusion 112 and communicated with the primary protrusion 112; of course, it can be not communicated with the primary protrusion 112. The shape of the large protrusion 121 is optional, but it has symmetry, so as to balance the blade. The large protrusion 121 and the primary protrusion 112 both have the role of strengthening the anti-bending strength of the thin shredder blade 10. And the 10 processing of the large protrusion 121 can be done through punching the archetypal blade body during punching the archetypal cutting part, which is preferable, or after the processing of the cutting part 11 is completed. The shape of the thin shredder blade 10 can also be oval, regular polygonal or other suitable shapes.

Figure 2:
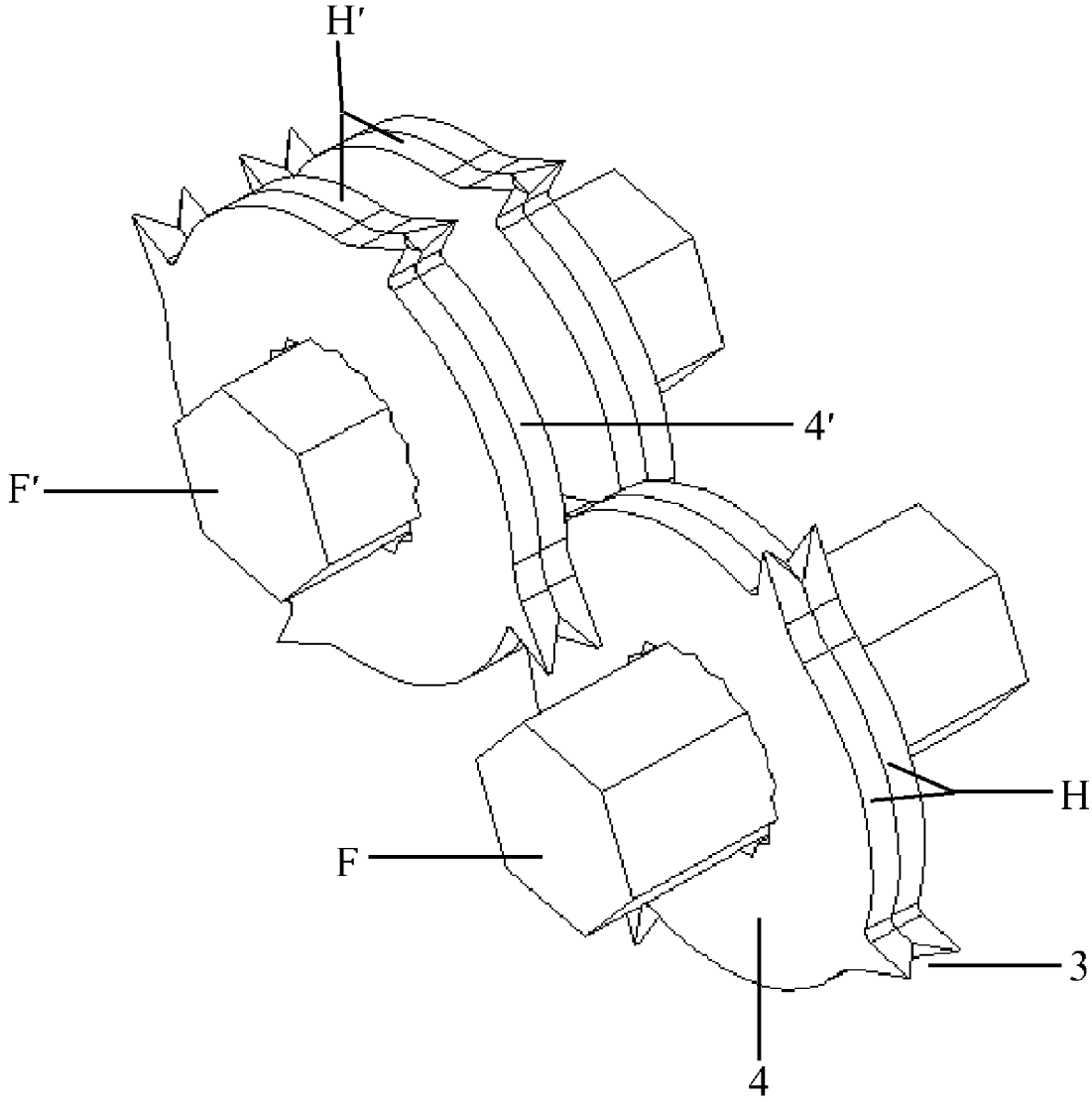
FIG. 2 is a perspective view of the prior art blade assembly of common shredders.
Figure 3:
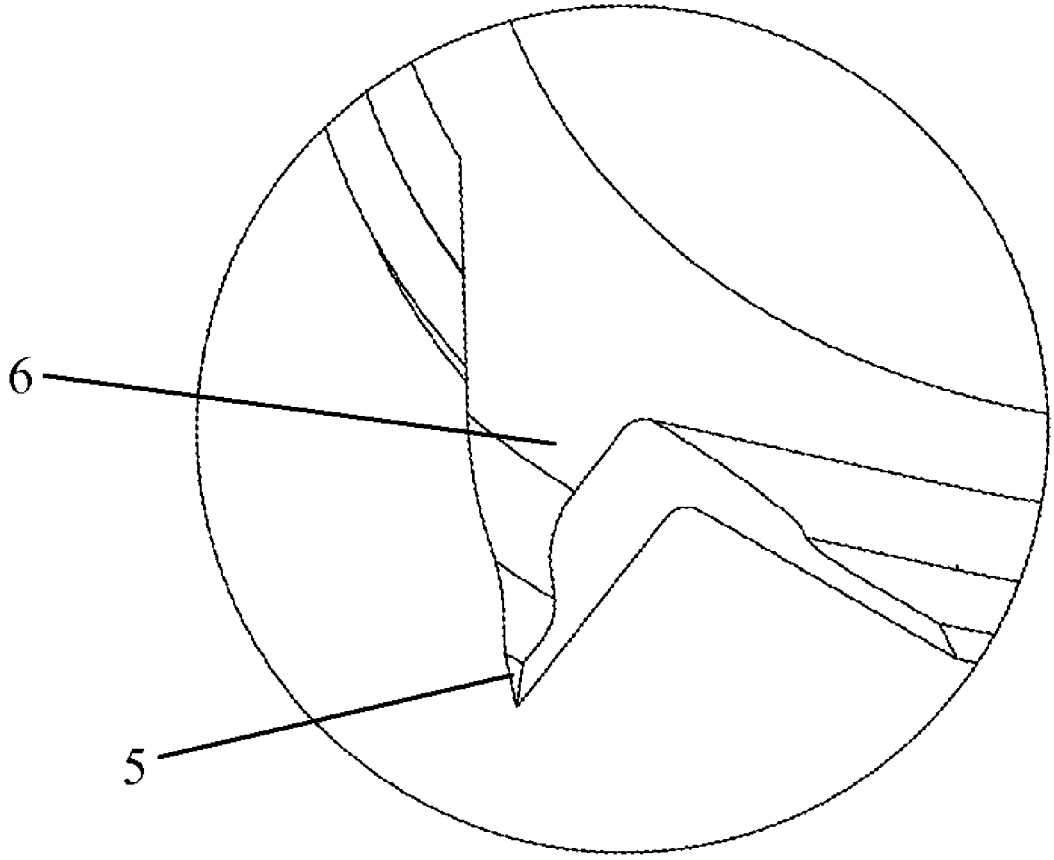
FIG. 3 is a partial enlarged perspective view of the prior art thin shredder blade having blade points with a step.
Figure 4A:
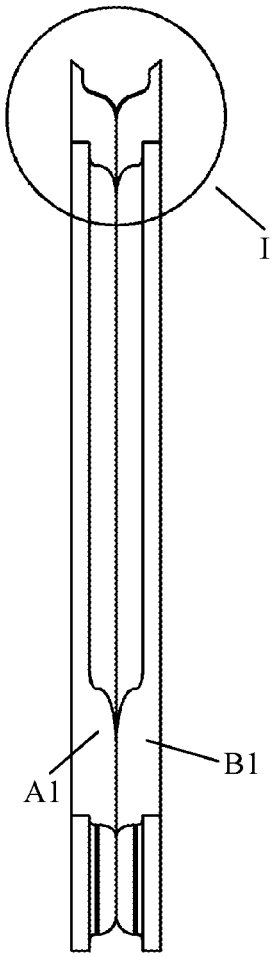
FIG. 4*a* is a side view of a prior art blade set formed by combining two thin shredder blades having blade points with a step shown in FIG. 3.
Figure 4B:
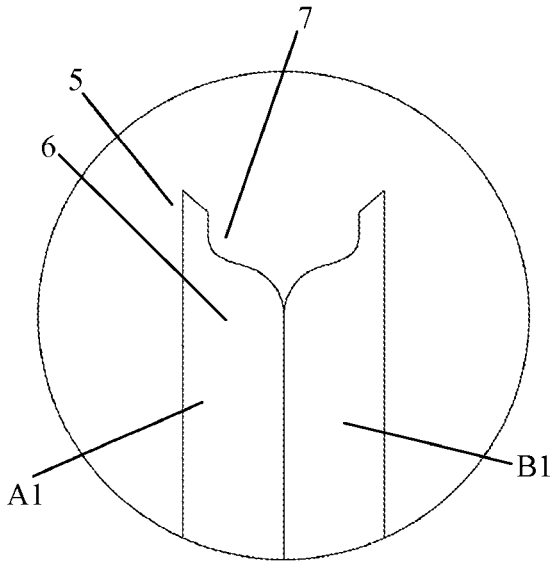
FIG. 4*b* is a partial enlarged schematic view of the area I of FIG. 4*a*.
Figure 12A:
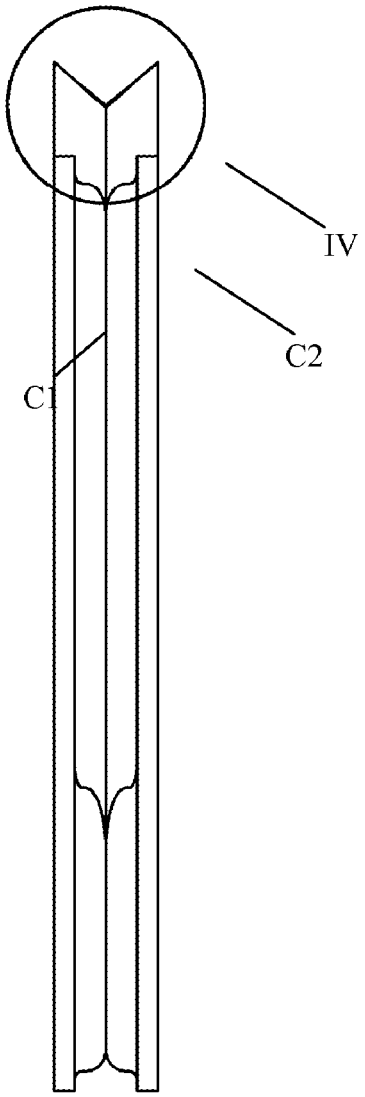
FIG. 12*a* is a side view of the blade set formed by combining two examples shown in FIG. 5, in accordance with the teachings of the present invention.
Figure 12B:
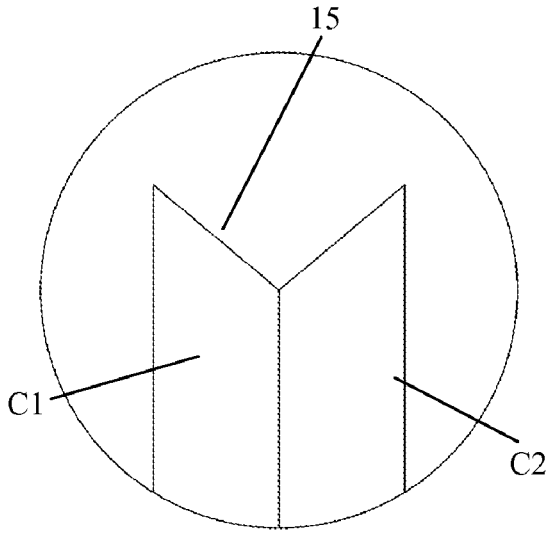
FIG. 12*b* is a partial enlarged schematic view of the area IV of FIG. 12*a*.

When a blade set 14 is formed by combining two thin shredder blades C1 and C2 mounted on the shaft A in the back-to-back manner, that is, protrusion against protrusion, as shown in FIG. 2, the cutting parts of these two shredder blades C1 and C2 would assume an V-like knife-edge 15, the side view of which is shown in FIG. 12*a* and FIG. 12*b*, the blade set 14 acts as one cutting unit, several cutting units are spaced by spacing rings 16 to make the distance of two cutting units is just the thickness of one cutting unit, and mounted on the shaft A to be the shaft A group, while on the opposite shaft B, another blade set 17 is formed by combining two shredder blades D1 and D2 spaced by spacing ring 16 in the face-to-face manner, and acts as another cutting unit, several cutting units are mounted on the shaft B in the cutting part to cutting part manner to be the shaft B group.

Thus, when the two shaft groups A and B are driven by the motor to rotate reversely, as the directions of the arrows in FIG. 13, the blade set 14 and the blade set 17 rotate reversely, when papers to be shredded pass through the two reverse rotatory shafts A and B, the opposing rotation of the blade circumferences, i.e. the blade bodies 12 and 12', would cut the papers like scissors into strips, and through the opposing rotation of the V-shaped knife-edge 15 and the opposite blade body 12', the knife-edge 15 (as shown in FIG. 13) would penetrate the papers firstly and then would cut the strips crossly to fragment the strips into chips, thereby to achieve the shredding function.

In fact, the function achieved by the blade set 14 and the blade set 17 just equals to that achieved by the previous blade sets Hand H' (as shown in FIG. 2), but the unique design of the above elements of the thin shredder blade 10, such as the annular large protrusion 121 (as shown in FIG. 5, FIG. 6 and FIG. 7) of the blade body 12, the primary protrusion 112 (as shown in FIG. 5, FIG. 6 and FIG. 7) of the cutting part 11, the inclined plane 114 and the first plane 117, causes the thin shredder blade 10 to achieve the same shredding effect of the common shredder completely, and reduces the weight of the blade greatly to realize the aim of reducing the material cost of the single production and the whole shredder cost greatly, so as to significantly reduce the production cost, at the same time as a result of the greatly reduced weight of the blade, the power consumption of the motor is also greatly reduced, so as to save energy. When the height of the primary protrusion 112 of the cutting part 11 of the thin shredder blade 10 is smaller, the distance of two blade points of two blades in one blade set formed by two thin shredder blades 10 will be smaller, thus the paper would be shredded smaller with them than with common shredders.

While the present invention has been particularly shown and described with references to preferred embodiments thereof, it will be understood by those skilled in the art that various changes in form and details may be made therein without departing from the spirit and scope of the invention as defined by the claims. It is clearly understood therefore that the same is by way of illustration and example only and is not to be taken by way of limitation.

I claim:

1. A mechanical punching method, for manufacturing a thin shredder blade, comprising:

punching a thin metal sheet having an archetypal blade, so that an archetypal cutting part of the archetypal blade protrudes from the middle to form an archetypal protrusion, obtaining thereby the thickened archetypal cutting part;

stacking material thicker than the whole archetypal protrusion on the side surface of the archetypal cutting part;

cutting and punching the material stacked on the side surface to produce the inclined plane, wherein the cutting part at least further comprises a protrusion which protrudes from the cutting part and includes a top, a inclined plane extends between the top and the blade point, and wherein the blade points are made without steps.

2. The mechanical punching method according to claim 1, wherein in the stacking, increasing punching force is used to stack material thicker than the whole archetypal protrusion on the side surface of the archetypal cutting part.

3. The mechanical punching method according to claim 1, wherein in the stacking, finishing is used to stack material thicker than the whole archetypal protrusion on the side surface of the archetypal cutting part.

4. The mechanical punching method according to claim 1, wherein in the stacking, one of extruding or bending material is used to stack material thicker than the whole archetypal protrusion on the side surface of the archetypal cutting part.

5. The mechanical punching method according to claim 1, wherein the punching further comprises punching the archetypal blade body of the archetypal blade, so that the archetypal blade body protrudes to form at least one large protrusion which protrudes in the same direction as the archetypal protrusion.

6. The mechanical punching method according to claim 5, wherein the large protrusion is an annular large protrusion.

7. The mechanical punching method according to claim 5, wherein the large protrusion is communicated with the archetypal protrusion.

8. The mechanical punching method according to claim 5, wherein the large protrusion is not higher than the archetypal protrusion.

9. The mechanical punching method according to claim 1, wherein the stacking further comprises stacking material thicker than the whole archetypal protrusion on the front surface of the archetypal cutting part.

10. The mechanical punching method according to claim 9, wherein the cutting and punching further comprises cutting and punching the material stacked on the front surface to produce a first plane which extends between the top and the first hemline of the cutting part.

11. The mechanical punching method according to claim 9, wherein the increasing the punching force is used to stack material the thickness of which is thicker than the whole archetypal protrusion on the side surface of the archetypal cutting part.

12. The mechanical punching method according to claim 9, wherein the finishing is used to stack material thicker than the whole archetypal protrusion on the side surface of the archetypal cutting part.

13. The mechanical punching method according to claim 9, wherein the one of extruding or bending material is used to stack material thicker than the whole archetypal protrusion on the side surface of the archetypal cutting part.

14. A mechanical punching method, according to claim 1, comprising:

punching a thin metal sheet having an archetypal blade, so that the archetypal cutting part of the archetypal blade protrudes from the middle to form an archetypal protrusion, thus the thickened archetypal cutting part is obtained, and the archetypal blade body protrudes to form at least one large protrusion which protrudes in the same direction as the archetypal protrusion;

stacking material thicker than the whole archetypal protrusion on the side surface and the front surface of the archetypal cutting part;

cutting and punching the material stacked on the side surface and the front surface respectively to produce the inclined plane and the first plane, wherein an acute angle is formed by the inclined plane and the blade body.

* * * * *